US006089425A

United States Patent [19]

Fair et al.

[11] Patent Number: 6,089,425

[45] Date of Patent: Jul. 18, 2000

[54] CONSUMER-ASSEMBLED FRAME FOR INFANT CARRIER

[75] Inventors: Paul Fair, Denver, Colo.; David Jetter, Piqua, Ohio

[73] Assignee: Evenflo Company, Inc., Vandalia, Ohio

[21] Appl. No.: 09/177,175

[22] Filed: Oct. 22, 1998

[51] Int. Cl.[7] ..... A61G 1/00

[52] U.S. Cl. ..... 224/161; 224/160

[58] Field of Search ..... 224/158, 159, 224/160, 161; 403/377, DIG. 6

[56] References Cited

U.S. PATENT DOCUMENTS

| | | | |
|---|---|---|---|
| 2,620,210 | 12/1952 | Wuster | 403/377 |
| 3,713,568 | 1/1973 | Sloan . | |
| 3,989,173 | 11/1976 | Gebhard . | |
| 4,044,931 | 8/1977 | Catelli . | |
| 4,676,466 | 6/1987 | Nakao et al. . | |
| 4,746,044 | 5/1988 | Arvizu et al. . | |
| 4,747,526 | 5/1988 | Launes . | |
| 4,762,256 | 8/1988 | Whitaker | 224/161 |
| 5,020,709 | 6/1991 | Hoaglan . | |
| 5,419,281 | 5/1995 | Williams et al. . | |
| 5,609,279 | 3/1997 | O'Shea . | |
| 5,626,271 | 5/1997 | Messey et al. . | |
| 5,676,287 | 10/1997 | Huang . | |
| 5,704,523 | 1/1998 | Wang . | |
| 5,779,386 | 7/1998 | Eichhorn | 403/377 X |

*Primary Examiner*—Gregory M. Vidovich
*Attorney, Agent, or Firm*—Thompson Hine & Flory LLP

[57] ABSTRACT

An infant carrier system with a consumer-assembled frame is disclosed. The system includes a central frame assembly comprising two generally parallel tubes vertically disposed and positionable upon the back of an infant care provider. The central frame assembly includes two free upper ends and two free lower ends. A bracket is coupled to each tube intermediate to its upper and lower ends thereof. An upper frame assembly is formed in a generally inverted U-shaped configuration. The upper frame assembly has parallel legs extending horizontally terminating in free ends couplable with respect to the free upper ends of the tubes of the central frame assembly. A lower frame assembly is provided with a generally U-shaped configuration with a horizontal leg positionable upon the floor for support independent of a child care provider. The lower frame assembly has generally vertical parallel rods extending upwardly spaced a distance less than the length of the horizontal leg, the vertical rods terminating in cylindrical free ends pivotally couplable with respect to the central frame assembly.

4 Claims, 3 Drawing Sheets

CONSUMER-ASSEMBLED FRAME FOR INFANT CARRIER

BACKGROUND OF THE INVENTION

1. Field of the Invention

The present invention relates to an infant carrier system with a consumer-assembled frame and more particularly pertains to coupling and uncoupling a rigid frame with respect to the fabric portion of infant carrier for increased convenience.

2. Description of the Prior Art

The use of child care products of known designs and configurations is known in the prior art. More specifically, child care products of known designs and configurations heretofore devised and utilized for the purpose of improving the safety and convenience of child care products through known methods and apparatuses are known to consist basically of familiar, expected, and obvious structural configurations, notwithstanding the myriad of designs encompassed by the crowded prior art which has been developed for the fulfillment of countless objectives and requirements.

While the known prior art devices fulfill their respective, particular objectives and requirements, the aforementioned patents do not describe an infant carrier system with a consumer-assembled frame as disclosed herein.

In this respect, the infant carrier system with a consumer-assembled frame according to the present invention substantially departs from the conventional concepts and designs of the prior art, and in doing so provides an apparatus primarily developed for the purpose of coupling and uncoupling a rigid frame with respect to the fabric portion of infant carrier for increased convenience.

Therefore, it can be appreciated that there exists a continuing need for a new and improved infant carrier system with a consumer-assembled frame which can be used for coupling and uncoupling a rigid frame with respect to the fabric portion of an infant carrier for increased convenience. In this regard, the present invention substantially fulfills this need.

SUMMARY OF THE INVENTION

In view of the foregoing disadvantages inherent in the known types of child care products of known designs and configurations now present in the prior art, the present invention provides an improved infant carrier system with a consumer-assembled frame. As such, the general purpose of the present invention, which will be described subsequently in greater detail, is to provide a new and improved infant carrier system with a consumer-assembled frame and method which has all the advantages of the prior art and none of the disadvantages.

To attain this, the present invention essentially comprises a new and improved infant carrier system with a consumer-assembled frame for carrying a child by an infant care provider or for resting the system on the ground with a supported child. The system includes a central frame assembly comprising two generally parallel hollow metal tubes vertically disposed and positionable upon the back of an infant care provider. The central frame assembly is formed with two lower free ends and two upper free ends with outwardly extending spring-urged locking balls therethrough. The upper extent of the central frame assembly is arcuate and the lower extent of the central frame assembly is formed of two angularly linear extents. A plastic bracket is coupled to each tube intermediate to its upper and lower ends thereof. A laterally disposed plastic cross brace is provided. The cross brace is formed in an arcuate configuration having free ends coupling the tubes of the central frame assembly between the brackets and lower free ends of the tubes. The cross brace is thus conformable to the lower back of an infant care provider. An upper frame assembly is provided in a generally inverted U-shaped configuration. The upper frame assembly has parallel legs extending horizontally terminating in free ends receiving the free upper ends of the tubes of the central frame assembly and with radial apertures extending therethrough. The upper portion of the upper frame assembly is generally horizontally disposed. A lower frame assembly is provided in a generally U-shaped configuration with a horizontal leg positionable upon the floor for support independent of a child care provider. The lower frame assembly has generally vertical parallel rods extending upwardly spaced a distance less than the length of the horizontal leg. The vertical rods terminate in cylindrical free ends including one with a smaller diameter and one with a larger diameter. The one with a smaller diameter has a spring-urged locking ball and the one with a larger diameter has a radial aperture. A tubular receiver is pivotally coupled to each bracket, one with a smaller diameter and one with a larger diameter. The one with the smaller diameter has a spring-urged locking ball and the one with the larger diameter has a radial aperture and is adapted to receive a cooperable free end of the lower frame assembly. A fabric cover encases the majority of the frame for the receipt of a child therein and shoulder straps are provided for being received by the shoulders of a child care provider.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved infant carrier system with a consumer-assembled frame which has all of the advantages of the prior art Child care products of known designs and configurations and none of the disadvantages.

It is another object of the present invention to provide a new and improved infant carrier system with a consumer-assembled frame which may be easily and efficiently manufactured and marketed.

It is further object of the present invention to provide a new and improved infant carrier system with a consumer-assembled frame which is of durable and reliable constructions.

An even further object of the present invention is to provide a new and improved infant carrier system with a consumer-assembled frame which is susceptible of a low cost of manufacture with regard to both materials and labor, and which accordingly is then susceptible of low prices of sale to the consuming public, thereby making such infant carrier system with a consumer-assembled frame economically available to the buying public.

Even still another object of the present invention is to provide an infant carrier system with a consumer-assembled frame for coupling and uncoupling a rigid frame with respect to the fabric portion of an infant carrier for increased convenience.

Lastly, it is an object of the present invention to provide a new and improved infant carrier system with a consumer-assembled frame including a central frame assembly. The central frame assembly comprises an infant carrier system with a consumer-assembled frame. The system includes a central frame assembly comprising two generally parallel tubes vertically disposed and positionable upon the back of an infant care provider. The central frame assembly includes two free upper ends and two free lower ends. A bracket is coupled to each tube intermediate to its upper and lower ends thereof. An upper frame assembly is formed in a generally inverted U-shaped configuration. The upper frame assembly has parallel legs extending horizontally terminating in free ends couplable with respect to the free upper ends of the tubes of the central frame assembly. A lower frame assembly is provided with a generally U-shaped configuration with a horizontal leg positionable upon the floor for support independent of a child care provider. The lower frame assembly has generally vertical parallel rods extending upwardly spaced a distance less than the length of the horizontal leg, the vertical rods terminating in cylindrical free ends pivotally couplable with respect to the central frame assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
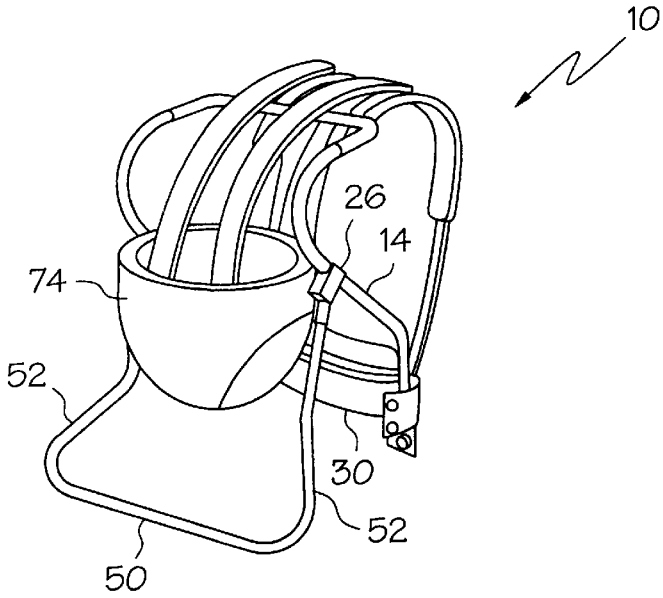
FIG. 1 is a perspective view of the preferred embodiment of the infant carrier system with a consumer-assembled frame constructed in accordance with the principles of the present invention.
Figure 2:
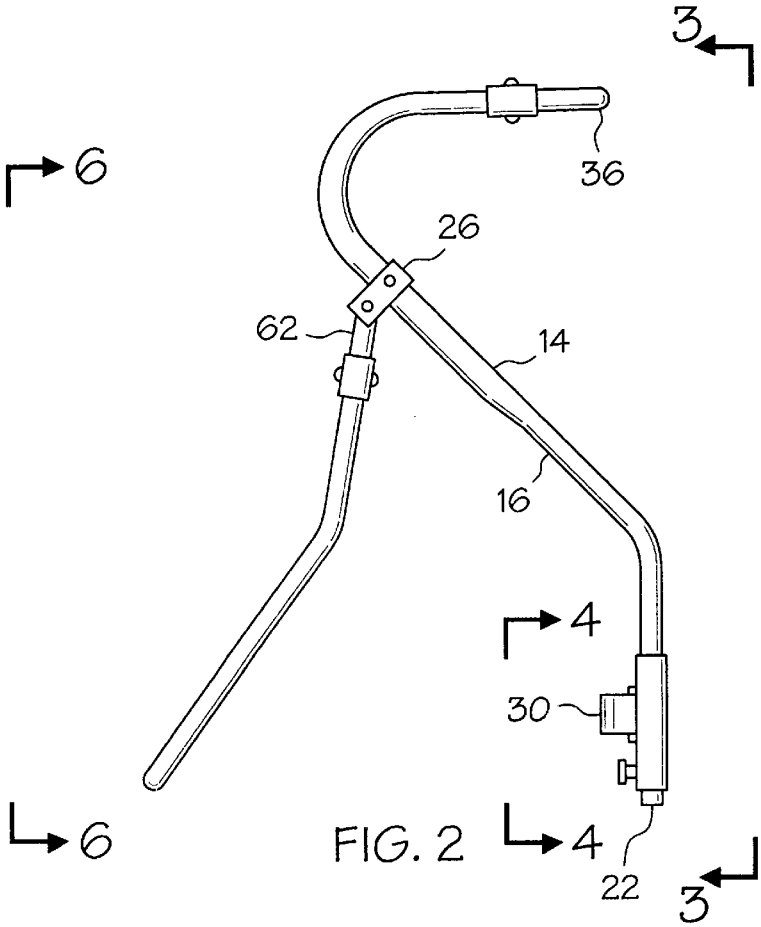
FIG. 2 is a side elevational view of the various frame assembly components with the fabric removed.
Figure 3:
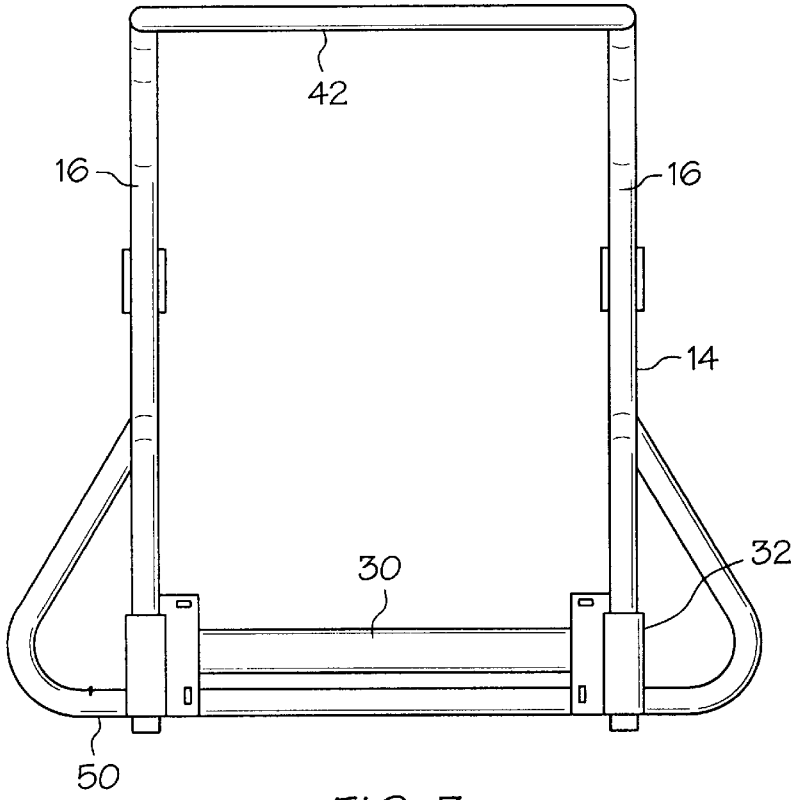
FIG. 3 is front elevational view of the frame assemblies taken along line 3—3 of FIG. 2.
Figure 4:
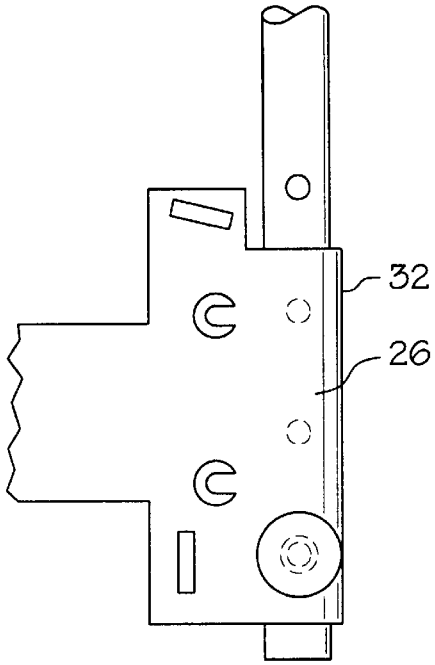
FIG. 4 is an enlarged partially side elevational view of one bracket taken at line 4—4 of FIG. 2.
Figure 5:
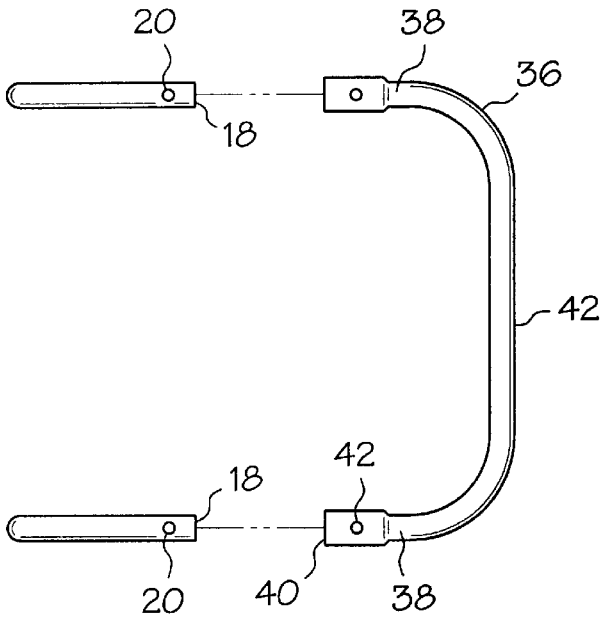
FIG. 5 is an exploded top plan view of a portion of the upper frame assembly.
Figure 6:
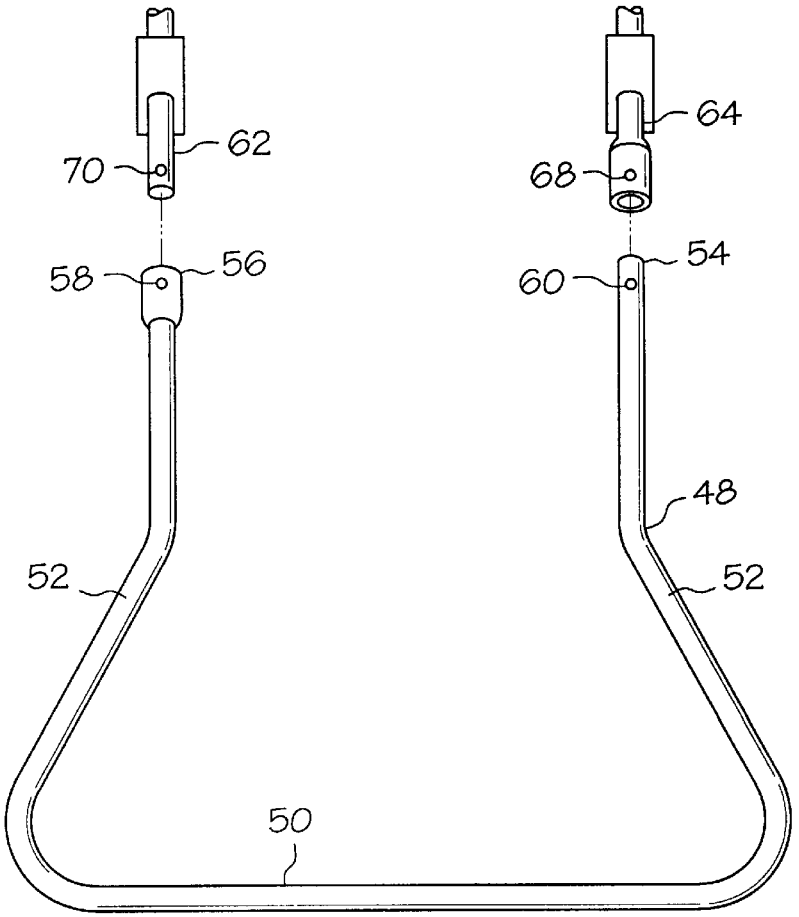
FIG. 6 is an exploded rear elevational view of the lower frame assembly taken at line 6—6 of FIG. 2.

With reference now to the drawings, and in particular to FIG. 1 thereof, the preferred embodiment of the new and improved infant carrier system with a consumer-assembled frame embodying the principles and concepts of the present invention and generally designated by the reference numeral 10 will be described.

The present invention, the infant carrier system with a consumer-assembled frame 10, is comprised of a plurality of components. Such components in their broadest context include a central frame assembly, a plastic cross brace, an upper frame assembly and a lower frame assembly. Such components are individually configured and correlated with respect to each other so as to attain the desired objective.

The new and improved infant carrier system 10 with a consumer-assembled frame for carrying a child by an infant care provider or for resting the system on the ground with a supported child comprises a central frame assembly 14 comprising two generally parallel hollow metal tubes 16 vertically disposed and positionable upon the back of an infant care provider. The central frame assembly includes two free upper ends 18 with outwardly extending spring-urged ball connectors 20 therethrough and two lower free ends 22.

The system further comprises a plastic bracket 26 coupled to each tube intermediate to its upper and lower ends thereof.

Further included in the system is a laterally disposed plastic cross brace 30 with an arcuate configuration having free ends 32 that couple the tubes of the central frame assembly between the brackets and lower free ends of the tubes. The cross brace is conformable to the lower back of an infant care provider.

An upper frame assembly 36 is provided in a generally inverted U-shaped configuration with parallel legs 38 extending horizontally terminating in free ends 40 receiving the free upper ends of the tubes of the central frame assembly and with radial apertures 42 which extend therethrough for receiving connectors 20. The upper portion 42 of the upper frame assembly is generally horizontally disposed in an arcuate configuration.

A lower frame assembly 48 is provided in a generally U-shaped configuration with a horizontal leg 50 positionable upon the floor for support independent of a child care provider and with generally vertical parallel rods 52 extending upwardly. The vertical rods terminate in cylindrical free ends 54, 56 including one with a smaller diameter 54 and one with a larger diameter 56. Free end 56 has a lower radial aperture 58 therethrough. End 54 has a spring-urged ball connector 60.

Additionally provided is a tubular receiver 62, 64 pivotally coupled to each bracket one with a smaller diameter 62 and one with a larger diameter 64. End 64 is adapted to receive a cooperable free end 54 of the lower portion with a radial aperture 68 to receive connector 60. Spring-urged ball connector 70 is receivable in the lower radial aperture 58.

The upper extent of the central frame assembly is arcuate. The lower extent of the central frame assembly is formed of two angularly linear extents.

Lastly provided is a fabric cover 74 that is attached to the frame for the receipt of a child therein and with shoulder straps for being received by the shoulders of a child care provider.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved infant carrier system with a consumer-assembled frame for carrying a child by an infant care provider or for resting the system on the ground with a supported child comprising, in combination:

a central frame assembly comprising two generally parallel hollow metal tubes vertically disposed and positionable upon the back of an infant care provider, the central frame assembly including two lower free ends and two upper free ends with outwardly extending spring-urged locking balls therethrough, the upper extent of the central frame assembly being arcuate and the lower extent of the central frame assembly being formed of two angularly linear extents;

a plastic bracket coupled to each tube intermediate to its upper and lower ends thereof;

a laterally disposed plastic cross brace with an arcuate configuration having free ends coupling the tubes of the central frame assembly between the brackets and the lower free ends of the tubes, the cross brace being conformable to the lower back of an infant care provider;

an upper frame assembly in a generally inverted U-shaped configuration with parallel legs extending horizontally terminating in free ends respectively for receiving the free upper ends of the tubes of the central frame assembly with radial apertures extending therethrough;

a lower frame assembly in a generally U-shaped configuration with a horizontal leg positionable upon the floor for support independent of a child care provider with generally vertical parallel rods extending upwardly, the vertical rods terminating in cylindrical free ends including one with a smaller diameter and one with a larger diameter, the one with a smaller diameter having a spring-urged locking ball and the one with a larger diameter having a radial aperture;

a tubular receiver pivotally coupled to each bracket, one with a smaller diameter and one with a larger diameter, the one with a smaller diameter having a spring-urged locking ball and the one with a larger diameter having a radial aperture, and adapted to receive a cooperable one of said cylindrical free ends of the lower frame assembly; and a fabric cover attached to the frame for receipt of a child therein and with shoulder straps for being received by the shoulders of a child care provider.

2. An infant carrier system with a consumer-assembled frame comprising:

a central frame assembly comprising two generally parallel tubes vertically disposed and positionable upon the back of an infant care provider, the central frame assembly including two free upper ends and two free lower ends;

a bracket coupled to each tube intermediate to its upper and lower ends thereof;

an upper frame assembly in a generally inverted U-shaped configuration with parallel legs extending horizontally terminating in free ends disengagingly couplable with respect to the free upper ends of the tubes of the central frame assembly; and a lower frame assembly in a generally U-shaped configuration with a horizontal leg positionable upon the floor for support independent of a child care provider and with generally vertical parallel rods extending upwardly, the vertical rods being disengagingly couplable to cylindrical free ends wherein the cylindrical free ends are pivotally couplable with respect to the brackets.

3. The system as set forth in claim 2 and further comprising a laterally disposed cross brace with an arcuate configuration having free ends coupling the tubes of the central frame assembly, the cross brace being conformable to the lower back of an infant care provider.

4. The system as set forth in claim 2 and further including a fabric cover attached to the frame for the receipt of a child therein and with shoulder straps for being received by the shoulders of a child care provider.

* * * * *